US007150646B2

(12) United States Patent
Trumper

(10) Patent No.: US 7,150,646 B2
(45) Date of Patent: Dec. 19, 2006

(54) CLAMP TERMINAL FOR CONNECTING ELECTRICAL CONDUCTORS

(75) Inventor: Thomas Trumper, Breitenbach (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 11/156,996

(22) Filed: Jun. 20, 2005

(65) Prior Publication Data

US 2005/0282429 A1 Dec. 22, 2005

(30) Foreign Application Priority Data

Jun. 22, 2004 (DE) ..... 10 2004 030 085

(51) Int. Cl.
*H01R 4/24* (2006.01)

(52) U.S. Cl. ..... 439/441

(58) Field of Classification Search ..... 439/441, 439/439, 787, 739

See application file for complete search history.

(56) References Cited

U.S. PATENT DOCUMENTS 3,945,711 A 3/1976 Hohorst et al.
5,575,695 A * 11/1996 De Bernardis ..... 439/838
6,074,242 A * 6/2000 Stefaniu et al. ..... 439/441
6,080,008 A * 6/2000 Frantz ..... 439/441
6,132,238 A 10/2000 Hartmann et al.

FOREIGN PATENT DOCUMENTS

| | | |
|---|---|---|
| DE | 1 871 248 | 5/1963 |
| DE | 23 17 040 | 10/1974 |
| DE | 295 00 566 | 3/1995 |
| DE | 295 12 567 | 10/1995 |
| DE | 44 45 603 | 6/1996 |
| DE | 196 08 356 | 8/1997 |
| DE | 196 54 523 | 7/1998 |
| DE | 299 14 482 | 1/2001 |
| DE | 203 03 537 | 5/2003 |

* cited by examiner

*Primary Examiner*—Phuong Dinh
(74) *Attorney, Agent, or Firm*—Salter & Michaelson

(57) ABSTRACT

A clamp terminal for connecting electrical conductors, which can be produced in a manner that reduces the structural size and optimizes costs. For this purpose, the clamp terminal includes two pieces of spring steel sheet, i.e., a spring steel sheet for the support plate and a spring steel sheet for the leaf spring, which are spot-welded in their head regions. The spring steel sheet for the support plate possesses in its foot region an uptake locking profile, in which, preferably, a round conductive core rod is engaged. Leaf spring tabs are formed from the spring steel sheet for the leaf spring, whose tab ends, together with the conductive core rod, form clamping sites for connecting the electrical conductors.

9 Claims, 2 Drawing Sheets

CLAMP TERMINAL FOR CONNECTING ELECTRICAL CONDUCTORS

TECHNICAL FIELD

The invention concerns a single clamp terminal as well as multiple clamp terminals formed therefrom for connecting one or more electrical conductors.

BACKGROUND DISCUSSION

Since 1973 (see DE 2,317,040 C3) and since 1995 (see DE 295 12 567 U1), clamp terminals of this type have been known, which use a rigid, solid support plate comprised of an electrically well-conducting material (e.g, made of a Cu material), which provides a large surface over all terminal sites of a multiple clamp terminal. On this support plate, which provides the electrically conducting connection between the individual clamping sites as well as represents the bearing element for all single clamp terminals joined together into a multiple clamp terminal, a leaf spring tab of spring steel sheet metal is fastened for each single clamp terminal and, in fact, for the most part, in such a way that all leaf spring tabs have a common head piece of spring steel sheet, which is fastened to the support plate by riveting or by clamping, since other, more cost-favorable types of connection between a piece of spring steel sheet and a support plate made of a different material have not been possible.

Due to this relatively expensive type of connection and also because of the higher material consumption for the previously used support plates of large surface that are made of relatively expensive materials, the clamp terminals of this type have come under cost pressure and new developments have been proposed by different manufacturers of clamp terminals, in which the current conducting capacity of the support plate of the prior art is replaced by a conductive core rod, whose material cross section can be better adapted to the required current conduction cross section, and in which the support function of the support plate of the prior art as well as the clamping functions of the individual leaf spring tabs are allocated to a common piece of spring steel sheet, from which the individual leaf spring tabs are punched out. In this connection, see DE Patent 196 54 523 C2 of the Applicant and the Utility Model Specification DE 203 03 537 U1 of the Electro-Terminal company.

Figure 1:
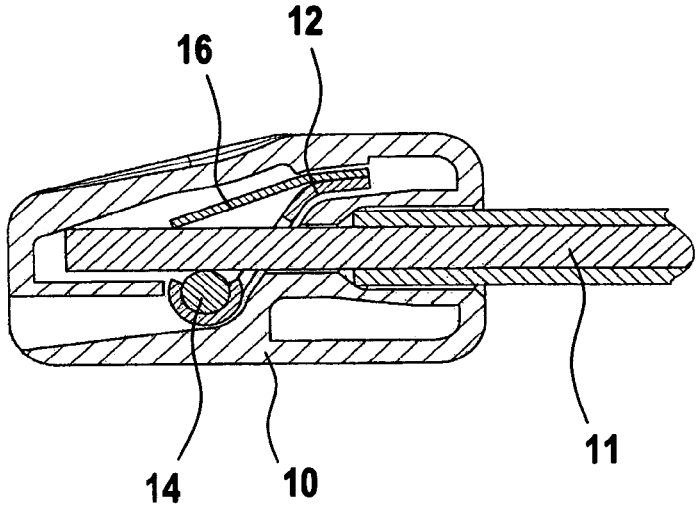

These last-named clamp terminals can in fact be produced less expensively than the type of clamp terminals named initially, but have the disadvantage for diverse fields of application that they are constructed too large, in particular, when multiple clamp terminals are required, which have a plurality of single clamp terminals disposed in a row next to one another, as this is shown, e.g., in DE 203 03 537 U1 in FIG. 1.

SUMMARY OF THE INVENTION

The object of the present invention consists of further developing clamp terminals of this generic type that are reduced in structural size and produced in a cost-optimized manner.

This object is solved for both single clamp terminals and for multiple clamp terminals.

The teaching of the invention utilizes the cost advantage which results due to the use of a conductive core rod, whose material cross section is adapted to the maximally required current conduction cross section. Relatively expensive Cu material is used only in an amount that is necessary for purposes of current conduction. Preferably, the conductive core rod that is used has a circular cross section (other cross-sectional shapes are also possible) and is locked in a correspondingly shaped uptake locking profile of the spring steel sheet which is designated as a so-called spring steel sheet for the support plate in the terminology of the present invention, since this piece of spring steel sheet "supports" the conductive core rod.

The piece of spring steel sheet for the leaf spring can be distinguished from this piece of spring steel sheet for the support plate, and this forms the leaf spring tab in a single clamp terminal, or the individual leaf spring tabs for a multiple clamp terminal are formed from this and are separated from one another by means of a slit in an embodiment of the invention. According to the teaching of the invention, the spring steel sheet for the leaf spring and the spring steel sheet for the support plate lie in two layers on top of one another in the head region of the leaf spring tabs, and in fact lie flat on top of one another. Since extensive material uniformity exists, both layers of spring steel sheet can be very well spot-welded to one another both rapidly and cost-favorably in an automated manufacturing process, whereupon an extremely flat, space-saving connection of the two pieces of spring steel sheet lying on top of one another is formed.

The two-layer arrangement of the spring steel sheet for the support plate and the spring steel sheet for the leaf spring is also extremely short in structure (measured in the direction of the conductive core rod). For each single clamp terminal in the direction of the conductive core rod, only a structural width is required that corresponds to the minimum structural width of the spring steel sheet for the support plate. This minimum structural width is determined in advance for a specific standard cross-sectional region of the electrical conductor to be connected to the clamp terminal by means of the width of the conductor opening in the spring steel sheet for the support plate employed for inserting the conductor and is determined by the width of the lateral edge pieces, which bound the conductor opening and which are necessary for reasons of strength as well as for assuring optionally desired spring properties of the spring steel sheet for the support plate.

It is an important advantage that in the clamp terminal according to the invention, the minimum structural width of the spring steel sheet for the support plate and the minimum structural width of the spring steel sheet for the leaf spring are not added in the direction of the conductive core rod, so that multiple clamp terminals that are reduced in structural size can be produced with a plurality of single clamp terminals.

Another advantage results from an embodiment of the invention, in which the respective dimensions, material thicknesses and spring properties of the spring steel sheet for the support plate and of the spring steel sheet for the leaf spring of a clamp terminal are dimensioned in such a way that both pieces of the spring steel sheet carry out the necessary opening stroke of the clamping site with a shared elastic spring property when an electrical conductor is connected.

The shared loading of the two pieces of spring steel sheet need not be equal. Any distribution of the spring excursion on one or the other piece of spring steel sheet may be of advantage when the clamping site is opened, as long as opening is always achieved in this way; the length of the leaf spring tabs can be designed so that they are short, which also can be utilized for a reduction in structural size.

DETAILED DESCRIPTION OF THE DRAWINGS

Figure 2:
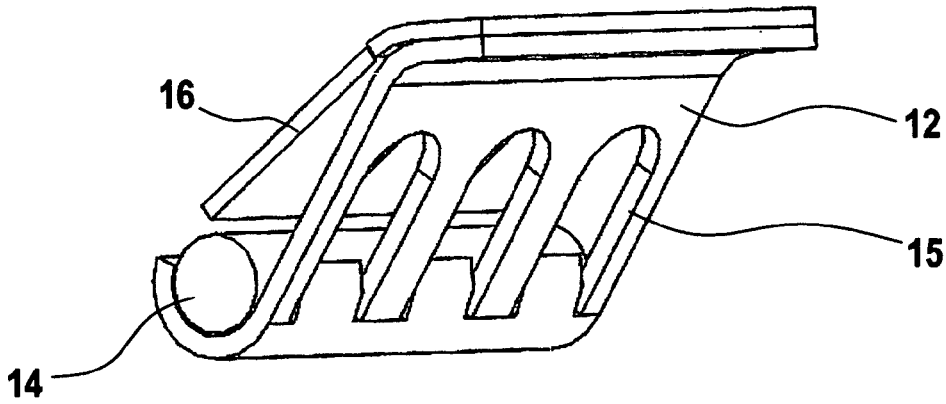
Figure 3:
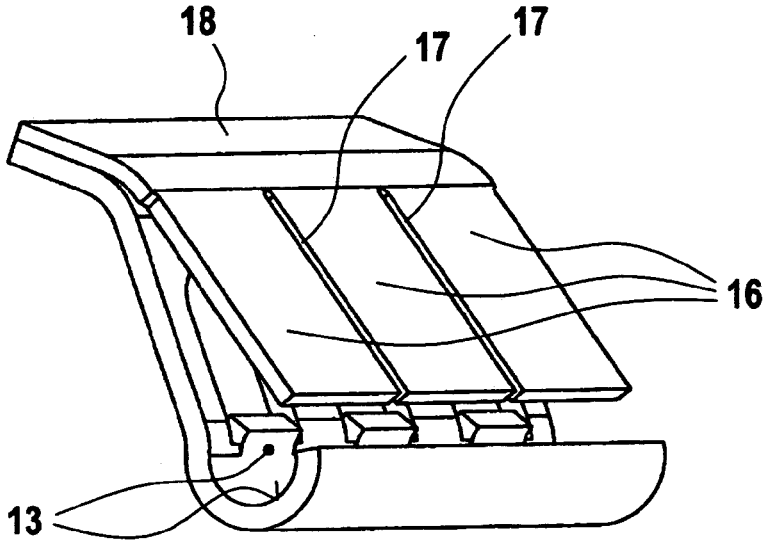
Figure 4:
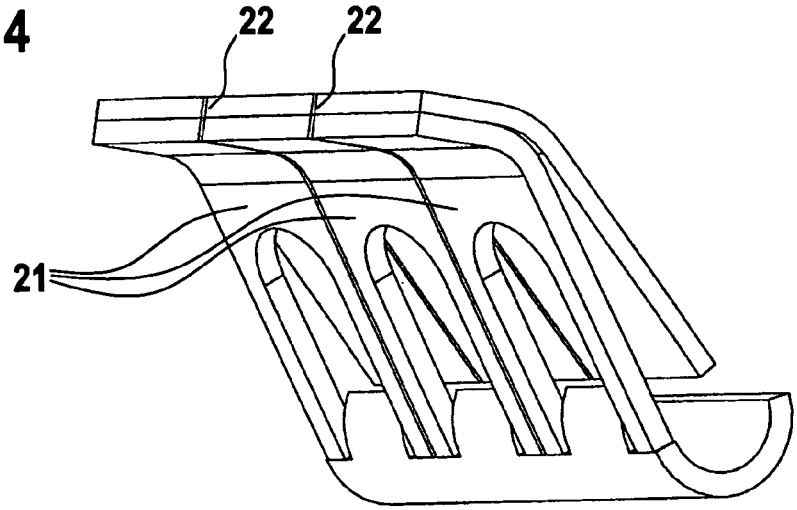
Figure 5:
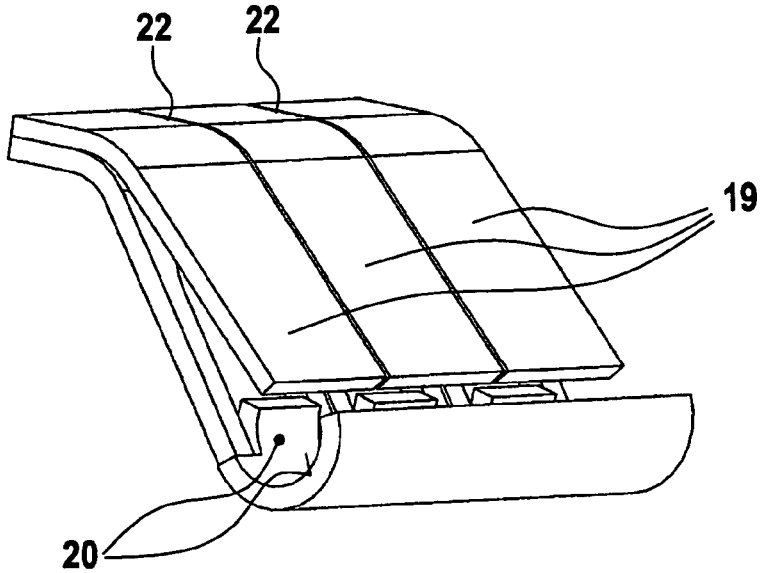
Figure 6:
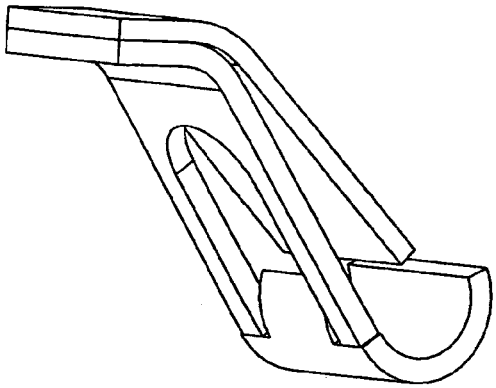
Figure 7:
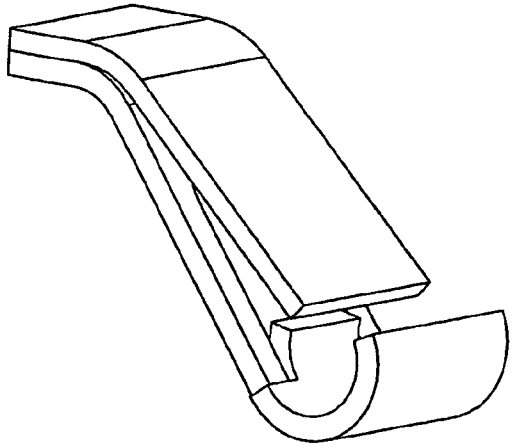

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIG. 1 shows the cross section through a box clamp terminal according to the invention, FIGS. 2 and 3 show in perspective representation the contact insert of the box clamp terminal according to FIG. 1, FIGS. 4 and 5 show in perspective representation a second example of embodiment of a multiple clamp terminal, FIGS. 6 and 7 show an example of embodiment of a single clamp terminal.

DETAILED DESCRIPTION

FIG. 1 shows the insulation housing 10 of a so-called box clamp terminal, i.e., connection clamp terminals for connecting several electrical conductors 11, which will be electrically connected to one another, e.g., in a distribution box of a building installation.

FIGS. 2 and 3 show the contact insert of the box clamp terminal according to FIG. 1, comprising a piece of spring steel sheet 12 for the support plate, this sheet possessing a shaped uptake locking profile 13 in the lower region of the drawing (see FIG. 3), in which a round conductive core rod 14 is locked (see FIG. 2). The spring steel sheet 12 for the support plate possesses a conductor opening 15 for each clamping site, and an electrical conductor 111 which is to be connected is inserted through this opening (see FIG. 1), in order to then be electrically and mechanically clamped in the allotted clamping site between a leaf spring tab 16 and the conductive core rod 14.

In the example of embodiment according to FIGS. 2 and 3, three leaf spring tabs 16 are present, which are formed from one piece of spring steel sheet and which are separated from one another by slits 17, so that they can spring independently of one another. All three leaf spring tabs 16 shown in FIG. 3 are joined together in their head region in a head piece of the spring steel sheet. This head piece 18 of the spring steel sheet for the leaf spring is spot-welded to the allocated upper region of the spring steel sheet 12 for the support plate.

FIGS. 4 and 5 show a contact insert for a triple clamp terminal, in which the single clamp terminals (in this regard, see the three leaf spring tabs 19 in FIG. 5) are joined together exclusively by means of an uptake locking profile 20 common to all single clamp terminals and by means of the conductive core rod (not shown) which is engaged in this uptake locking profile, whereby in other respects, the spring steel sheet 21 for the support plate (see FIG. 4) and the leaf spring tabs 19 are formed independently of one another, as is shown by the slits 22 that are provided between them and that can be well recognized in FIG. 4 and FIG. 5. Despite a high bonding strength of all three single clamp terminals into a triple clamp terminal, this example of embodiment makes possible an individual clamping of three single conductors independently of one another in terms of spring technology.

FIGS. 6 and 7 show the contact insert (without conductive core rod) of a single clamp terminal according to the invention, whose embodiment is selected corresponding to FIGS. 4 and 5. Such single clamp terminals (as shown in FIGS. 6 and 7) can be locked onto a conductive core rod in any number desired with fully automated manufacture and can then be mounted in an appropriately prepared insulation housing. Thus, individual multiple clamp terminals can be produced in a cost-favorable manner corresponding to the customer's requirement.

The invention claimed is:

1. A clamp terminal for the connection of an electrical conductor which is inserted through an opening in a support plate of the clamp terminal and is then clamped electrically and mechanically in a clamping site of the clamp terminal, with a leaf spring produced from a piece of spring steel sheet, which is fastened in a fixed position as a leaf spring tab with its head end on the support plate of the clamp terminal and whose tab end extends opposite a conductive core piece, the conductive core piece is comprised of an electrically well-conducting material and extends crosswise to the tab end of the leaf spring in such a way that the tab end of the leaf spring, together with the conductive core piece, forms the clamping site for the electrical conductor, the support plate is produced from a piece of spring steel sheet, to which the head end of the leaf spring, is fastened so that it lies flat with the support plate spring steel sheet;

and the conductive core piece is formed in the shape of a conductive core rod, which is attached in fixed position to the spring steel sheet for the support plate wherein the conductive core rod possesses a round cross section and is locked in a correspondingly shaped uptake locking profile of the spring steel sheet for the support plate.

2. The clamp terminal according to claim 1, wherein the spring steel sheet for the support plate and the head end of the spring steel sheet for the leaf spring are spot welded to one another.

3. The clamp terminal according to claim 1, wherein two or more single clamp terminals arranged in a row next to one another and are joined together in such a way that the single clamp terminals are joined together electrically and mechanically exclusively by means of a conductive core rod common to all single clamp terminals.

4. The clamp terminal according to claim 1, wherein two or more single clamp terminals arranged in a row next to one another and are joined together in such a way that the single clamp terminals are joined together electrically and mechanically exclusively by means of a conductive core rod common to all single clamp terminals and additionally by means of an uptake locking profile common to all single clamp terminals of the spring steel sheet for the support plate, these single clamp terminals otherwise each being formed independently of one another.

5. The clamp terminal according to claim 1, wherein two or more single clamp terminals arranged in a row next to one another and are joined together in such a way that all single clamp terminals are joined together electrically and mechanically by a common spring steel sheet for the support plate with an uptake locking profile common to all single clamp terminals and by means of a conductive core rod common to all single clamp terminals, wherein only the leaf springs of the clamping sites of the single clamp terminals are separated from one another by a slit and operate independently of one another.

6. A clamp terminal for the connection of an electrical conductor which is inserted through an opening in a support plate of the clamp terminal and is then clamped electrically and mechanically in a clamping site of the clamp terminal, with a leaf spring produced from a piece of spring steel sheet, which is fastened in a fixed position as a leaf spring tab with its head end on the support plate of the clamp terminal and whose tab end extends opposite a conductive core piece, the conductive core piece is comprised of an electrically well-conducting material and extends crosswise to the tab end of the leaf spring in such a way that the tab end of the leaf spring, together with the conductive core piece, forms the clamping site for the electrical conductor, the support plate is produced from a piece of spring steel sheet, to which the head end of the leaf spring, is fastened so that it lies flat with the support plate spring steel sheet;

and the conductive core piece is formed in the shape of a conductive core rod, which is attached in fixed position to the spring steel sheet for the support plate wherein two or more single clamp terminals arranged in a row next to one another and are joined together in such a way that the single clamp terminals are joined together electrically and mechanically exclusively by means of a conductive core rod common to all single clamp terminals and additionally by means of an uptake locking profile common to all single clamp terminals of the spring steel sheet for the support plate, these single clamp terminals otherwise each being formed independently of one another.

7. A clamp terminal for the connection of an electrical conductor which is inserted through an opening in a support plate of the clamp terminal and is then clamped electrically and mechanically in a clamping site of the clamp terminal, with a leaf spring produced from a piece of spring steel sheet, which is fastened in a fixed position as a leaf spring tab with its head end on the support plate of the clamp terminal and whose tab end extends opposite a conductive core piece, the conductive core piece is comprised of an electrically well-conducting material and extends crosswise to the tab end of the leaf spring in such a way that the tab end of the leaf spring, together with the conductive core piece, forms the clamping site for the electrical conductor, the support plate is produced from a piece of spring steel sheet, to which the head end of the leaf spring, is fastened so that it lies flat with the support plate spring steel sheet;

and the conductive core piece is formed in the shape of a conductive core rod, which is attached in fixed position to the spring steel sheet for the support plate wherein two or more singe clamp terminals arranged in a row next to one another and arc joined together in such a way that all single clamp terminals are joined together electrically and mechanically by a common spring steel sheet for the support plate with an uptake locking profile common to all single clamp terminals and by means of a conductive core rod common to all single clamp terminals, wherein only the leaf springs of the clamping sites of the single clamp terminals are separated from one another by a slit and operate independently of one another.

8. A clamp terminal for the connection of an electrical conductor which is inserted through an opening in a support plate of the clamp terminal and is then clamped electrically and mechanically between the tab end of a leaf spring and a conductive core piece, two or more single clamp terminals are arranged in a row next to one another and rejoined together in such a way that all leaf springs are produced from a piece of spring steel sheet, which head end lies flat on the support plate of the clamp terminal, also the support plate is produced from a piece of spring steel sheet with an extensive material uniformity to the piece of spring steel sheet from which the leaf springs are produced, so that the head end of the spring steel sheet from which the leaf springs are produced can be spot welded to the spring steel sheet from which the support plate is made, and the conductive core piece, which is common to all single clamp terminals and extends crosswise to the tab ends of the leaf springs, is produced of an electrically well-conducting material in the shape of a core rod having a round cross section, so that the core rod can be mechanically locked in a correspondingly shaped uptake locking profile of the spring steel sheet from which the support plate is made.

9. The clamp terminal according to claim 8, wherein the piece of spring steel sheet from which the leaf spring is produced, and the piece of spring steel sheet from which the support plate is produced are specified with respect to their dimensions, material thicknesses and spring properties in such a way that both pieces of spring steel sheet share the necessary opening stroke when an electrical conductor is clamped between the tab end of the leaf spring and the conductive core piece.

* * * * *